US009681780B2

(12) United States Patent
Ciavarella et al.

(10) Patent No.: US 9,681,780 B2
(45) Date of Patent: Jun. 20, 2017

(54) PRODUCT DISPENSING SYSTEM

(71) Applicant: GOJO Industries, Inc., Akron, OH (US)

(72) Inventors: Nick Emanno Ciavarella, Seven Hills, OH (US); Robert L. Quinlan, Jr., Stow, OH (US)

(73) Assignee: GOJO INDUSTRIES, INC., Akron, OH (US)

( * ) Notice: Subject to any disclaimer, the term of this patent is extended or adjusted under 35 U.S.C. 154(b) by 0 days.

(21) Appl. No.: 15/102,025

(22) PCT Filed: Dec. 5, 2014

(86) PCT No.: PCT/US2014/068837

§ 371 (c)(1),
(2) Date: Jun. 6, 2016

(87) PCT Pub. No.: WO2015/085195

PCT Pub. Date: Jun. 11, 2015

(65) Prior Publication Data

US 2016/0309966 A1 Oct. 27, 2016

Related U.S. Application Data

(60) Provisional application No. 61/912,052, filed on Dec. 5, 2013.

(51) Int. Cl.
*A47K 5/12* (2006.01)
*B67D 7/02* (2010.01)

(52) U.S. Cl.
CPC ..... *A47K 5/1212* (2013.01); *A47K 5/1211* (2013.01); *A47K 5/1217* (2013.01); (Continued)

(58) Field of Classification Search
CPC .. A47K 5/1211; A47K 5/1212; A47K 5/1217; A47K 5/1202; A47K 5/1204; (Continued)

(56) References Cited

U.S. PATENT DOCUMENTS 4,467,941 A * 8/1984 Du ..... B67D 1/1245 222/1
2002/0113083 A1 8/2002 Gauthier
(Continued)

FOREIGN PATENT DOCUMENTS

GB 2127778 4/1984

OTHER PUBLICATIONS

International Search Report cited in PCT Application No. PCT/US14/68837 mailed Apr. 17, 2015, pp. 1-16.

*Primary Examiner* — J. Casimer Jacyna
(74) *Attorney, Agent, or Firm* — Cooper Legal Group, LLC

(57) ABSTRACT

A fluid dispensing system, fluid reservoir, refill container for refilling the fluid reservoir, and method of refilling the fluid reservoir are provided. The fluid dispensing system includes a refill connection port or nozzle to which a refill container is connected when refilling the fluid reservoir. The fluid reservoir includes a piston head and an actuator for moving the piston head in a first direction and in a second direction. When the piston head is moved in the first direction, the fluid within the fluid reservoir is pressurized, causing the fluid to be dispensed through an outlet of the fluid reservoir. When the piston head is moved in the second direction, a vacuum is created within the fluid reservoir that draws fluid, from the refill container, into the fluid reservoir. The fluid dispensing system includes a valve to enable multiple refill containers to be coupled to the nozzle and/or the refill connection port.

15 Claims, 8 Drawing Sheets

(52) U.S. Cl.
CPC ..... *B67D 7/02* (2013.01); *B67D 7/0294* (2013.01); *A47K 2005/1218* (2013.01)

(58) Field of Classification Search
CPC ..... A47K 5/1205; A47K 5/1207; A47K 5/12; A47K 2005/1218; B67D 7/02; B67D 7/0227; B67D 7/0233; B67D 7/0238; B67D 7/0288; B67D 7/0294
See application file for complete search history.

(56) References Cited

U.S. PATENT DOCUMENTS

| | | | | |
|---|---|---|---|---|
| 2004/0247343 | A1 | 12/2004 | Matsumoto et al. | |
| 2005/0155988 | A1 | 7/2005 | Meehan et al. | |
| 2010/0024915 | A1* | 2/2010 | Thomas | A47L 13/50 141/69 |
| 2014/0263421 | A1* | 9/2014 | Urban | A47K 5/12 222/23 |

* cited by examiner

PRODUCT DISPENSING SYSTEM

RELATED APPLICATIONS

This application claims priority to U.S. Provisional Application 61/912,052, titled "PRODUCT DISPENSING SYSTEM" and filed on Dec. 5, 2013, which is incorporated herein by reference.

FIELD OF THE INVENTION

The current invention relates generally to sanitary bulk soap dispensers and in particular to dispensing systems having multiple refill reservoirs and air-tight refill connections.

BACKGROUND OF THE INVENTION

It is commonplace for publicly accessible facilities to provide soap dispensers in washrooms and other areas. Many dispensers have reservoirs that are open to the atmosphere. Such reservoirs are easily and inexpensively refilled from bulk soap stored in bottles or jugs. However, studies have shown that over time soap containers open to the atmosphere generate unsanitary bio-films. Soap used from these containers actually deposits germs onto the hands of the user during use. Even after cleaning the reservoir, remediation studies have determined that bio-films regenerate despite using strong oxidizers like bleach.

To overcome the detriments of open top dispensers, the reservoir in some dispensers is not refilled when the system is replenished. These systems are designed to receive disposable refill units produced in a sanitary environment. When empty of product, the whole reservoir is replaced along with the accompanying nozzle and pump. In this way, every part wetted by soap is disposed of when the dispenser is replenished. This greatly reduces and/or eliminates the germination of bio-films. However, determining how much soap is remaining in the reservoir, and when to replace it, can be difficult. If the reservoir is replaced before it is empty, then product is wasted. If the dispenser runs out of soap, then users are unable to clean their hands.

What is needed is a way of conveniently replenishing soap reservoirs without exposing the reservoir or the product to ambient air and without interrupting service or running out of product. The embodiments of the invention described herein obviate the aforementioned problems.

SUMMARY OF THE INVENTION

In one embodiment of the subject invention, a fluid product dispensing system is provided that includes multiple reservoirs for holding fluid product, in which the storage and delivery system is sealed from exposure to ambient air. The system may be replenished from a sealed sanitary refill container connected to a port fluidly connected to the dispensing system. When one of the multiple reservoirs is empty, the dispensing system is operable to automatically dispense product from another reservoir.

In one particular embodiment, the port for refilling the dispensing system is mounted to a fixture, along with a separately mounted nozzle used to dispense product.

In another embodiment of the dispensing system, the dispensing system is refilled through the dispensing nozzle.

DETAILED DESCRIPTION

Figure 1:
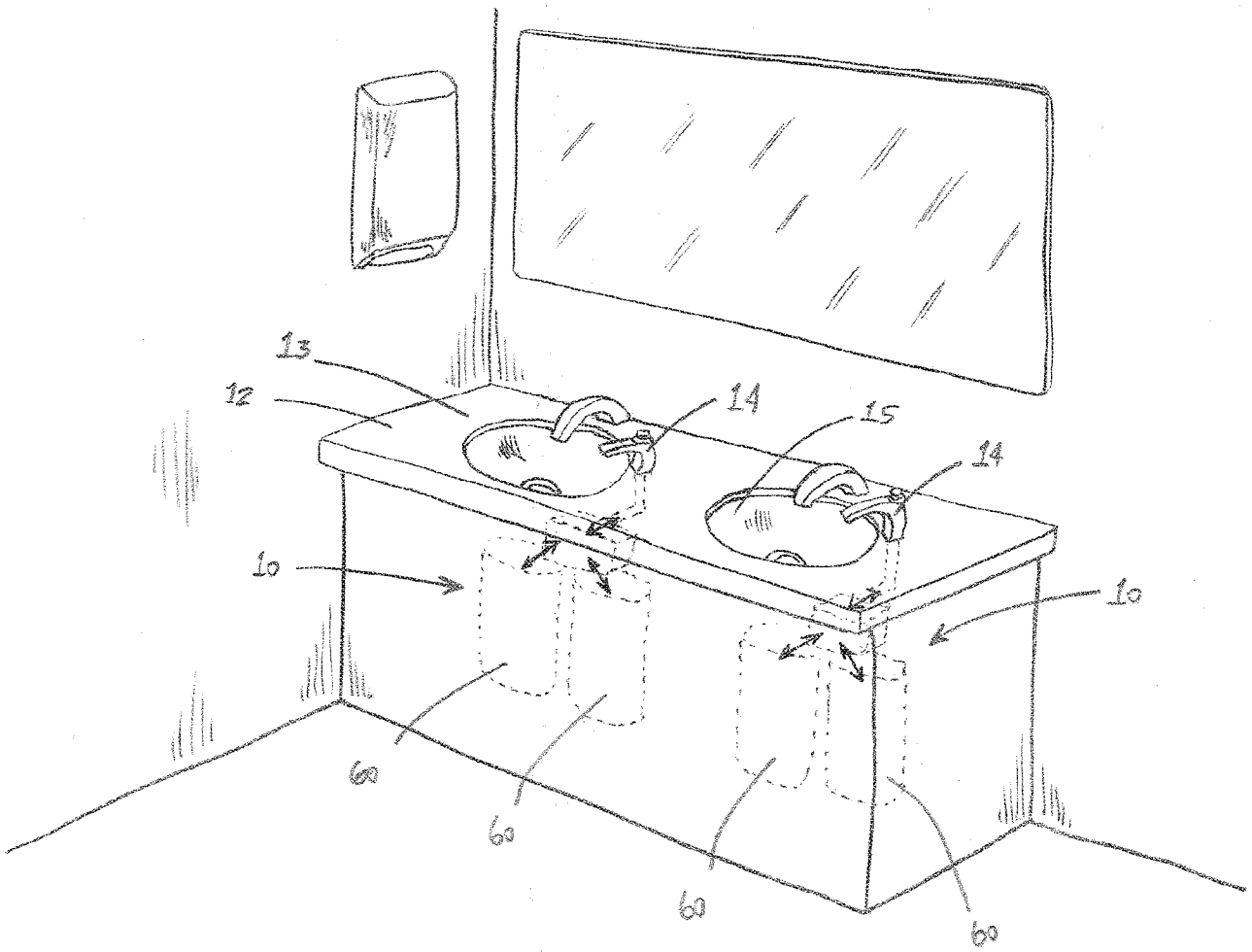
FIG. 1 depicts a fluid dispensing system according to the embodiments of the subject invention.

A product dispensing system, depicted in FIG. 1, dispenses a measured amount of fluid product according to the embodiments of the subject invention. In one exemplary instance, the dispensing system, shown generally at 10, dispenses hand care products like soap, lotion or sanitizers, although other types of products may similarly be dispensed from the dispensing system.

Figure 2:
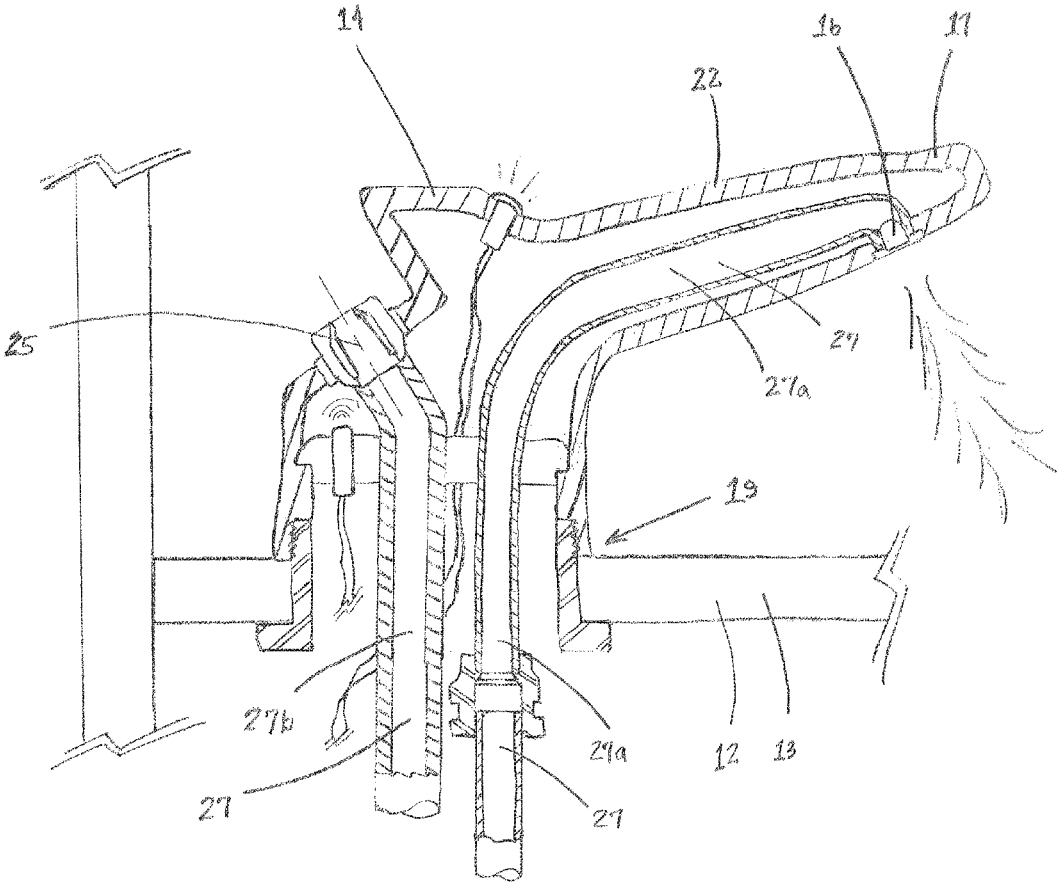
FIG. 2 is a cross sectional view of a fixture of the dispensing system according to the embodiments of the subject invention.

In the embodiment depicted in FIGS. 1 and 2, the dispensing system 10 includes a generally rigid fixture 14 having a product dispensing nozzle 16 received in an end 17 thereof. The fixture 14 may be mounted to a supporting structure 12, like for example a countertop 13, and positioned adjacent a source of clean water and a sink 15. It is noted that the fixture 14 may be mounted to other types of supporting structures, like a wall or dispenser stand, discussed further below. In one embodiment, fixture 14 has a faucet-like configuration including a base 19 for mounting it to the supporting structure 12 and an outwardly extending cantilevered arm 22. The nozzle 16 is positioned at the distal end of the arm 22. Conduits 27 in the fixture 14 are fluidly connected to a source of product, i.e. reservoir 60, that is designed to be replenished by way of the fixture 14.

Internally the fixture 14 may be at least partially hollow comprising one or more generally concave parts that fasten together to form a fixture assembly. One or more fluid conduits 27 may be received in the hollow interior for protection against damage from direct contact. As such, the fixture 14 may be constructed from impact resistance plastic or corrosion resistant metal. Fasteners or other means of affixing the concave parts together, not shown, may be chosen with sound engineering judgment. Alternative embodiments are contemplated where the fixture 14 may be generally solid formed as a single piece; having fluid channels molded or machined directly therein. These and other fixture configurations are to be construed as falling within the scope of coverage of the embodiments described herein.

The one or more conduits 27 in the fixture 14 function both: to channel product to the nozzle 16 and to refill the reservoir 60. In one particular embodiment, two fluid conduits 27*a*, 27*b* are provided. The first fluid conduit 27*a* is connected at a first end to the nozzle 16 as mentioned above.

The distal end of fluid conduit 27*a* terminates at a manifold (reference FIG. 3), which may comprise a selectively engage-able valve 50, to be discussed further below. The second fluid conduit 27*b* similarly connects at one end to the manifold, but terminates at a refill connection port 25 mounted onto the fixture 14.

Figure 3:
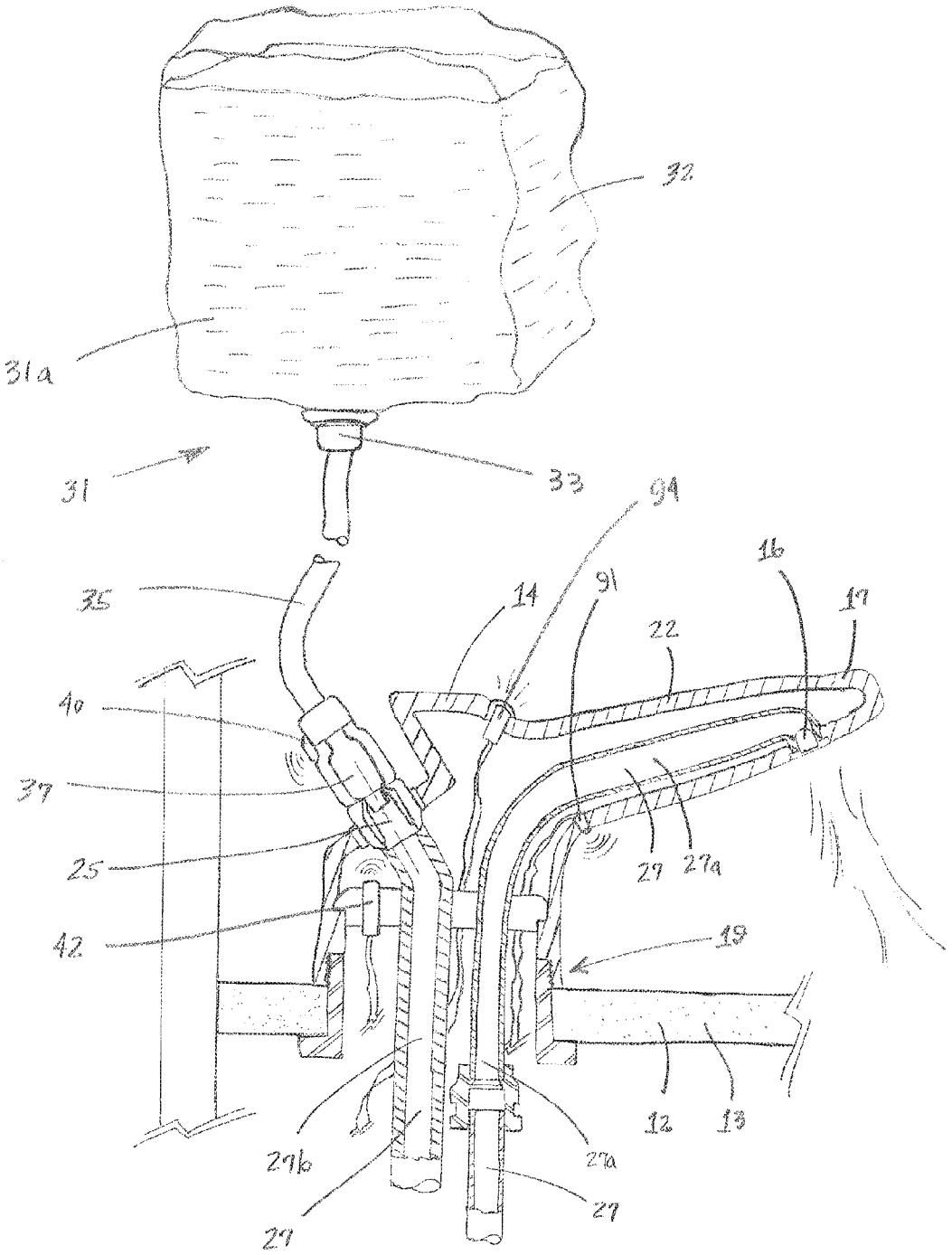
FIG. 3 is a cross sectional view of the fixture of the dispensing system shown in FIG. 2 attached to a refill unit, according to the embodiments of the subject invention.

With reference to FIGS. 2 and 3, the refill connection port 25 provides a fluid tight inlet for connecting to a soap refill container 31. When not in use, the connection port 25 may be closed off from exposure to the atmosphere. In one embodiment, the connection port 25 comprises a quick connect fitting. In this way, fluid flow through the connection port 25 is established only when the mating connector 37 from the soap refill container 31 is connected to it. Alternatively, the connection port 25 may be sealed by a cap secured via threads, not shown in the figures. Still any type of connection port 25 may be used that eliminates or substantially prevents exposure to the air.

The soap refill container 31 stores a predetermined quantity of fluid product in a reservoir area 32. In one particular embodiment, the volume in the reservoir area 32 may be substantially equivalent to the storage capacity of one of the dispensing system reservoirs 60. In this way, no product is left over or wasted when the dispensing system 10 is refilled. However, other volumes of refill storage area 32 may be used without limiting the scope of coverage of the embodiments described herein.

The refill container 31, referred to as refill bag 31*a*, may be constructed from pliable plastic material. In this way, as material flows out of the bag 31*a*, the walls of the container will collapse making it easy to dispose of once emptied of product. An outlet connection fitting 33 may be incorporated into the refill bag 31*a*. The fitting 33 may be affixed to an aperture formed in the bag 31*a* via any process known in the art, as long as a fluid tight seal is ensured. A hose 35 may extend from the outlet fitting 33. A second connection fitting 37 may be affixed to the hose 35 at its distal end for establishing fluid flow with the connection port 25. It follows that the second connection fitting 37 may also be a quick connect fitting that mates with the connection port 25. However, any type of fittings may be used as is necessary to provide a connection that does not expose the fluid product to the air.

With continue reference to FIG. 3, a validation key or tag may be implemented between refill container 31 and dispensing system 10 for validating the contents of the refill container 31. In one particular embodiment, connection fitting 37 includes an electronic key 40. The key 40 may comprise a RFID (Radio Frequency Identification) tag, which may be either passive or active. A corresponding interrogator 42 may be positioned proximal to the connection port 25. Accordingly, when the connection fitting 37 is brought near or installed onto the connection port 25, the interrogator 42 will automatically "ping" the electronic key 40 to verify that the correct refill container is being used. If the incorrect refill container is connected to the dispensing system 10, the control system will not initiate the refilling sequence. Depending on the range, i.e. strength, of the RFID signals, it is contemplated that the interrogator 42 may be mounted onto a circuit board located in the system controller or elsewhere in the dispensing system 10. Skilled artisans will appreciate that other forms of tagging, i.e. verification, may be used, like for example keyed mechanical fittings or optical sensor systems. Still, any manner of ensuring that the dispensing system 10 works only with the proper refill container 31 may be chosen as is consistent for use with the embodiments of the subject invention.

Figure 4:
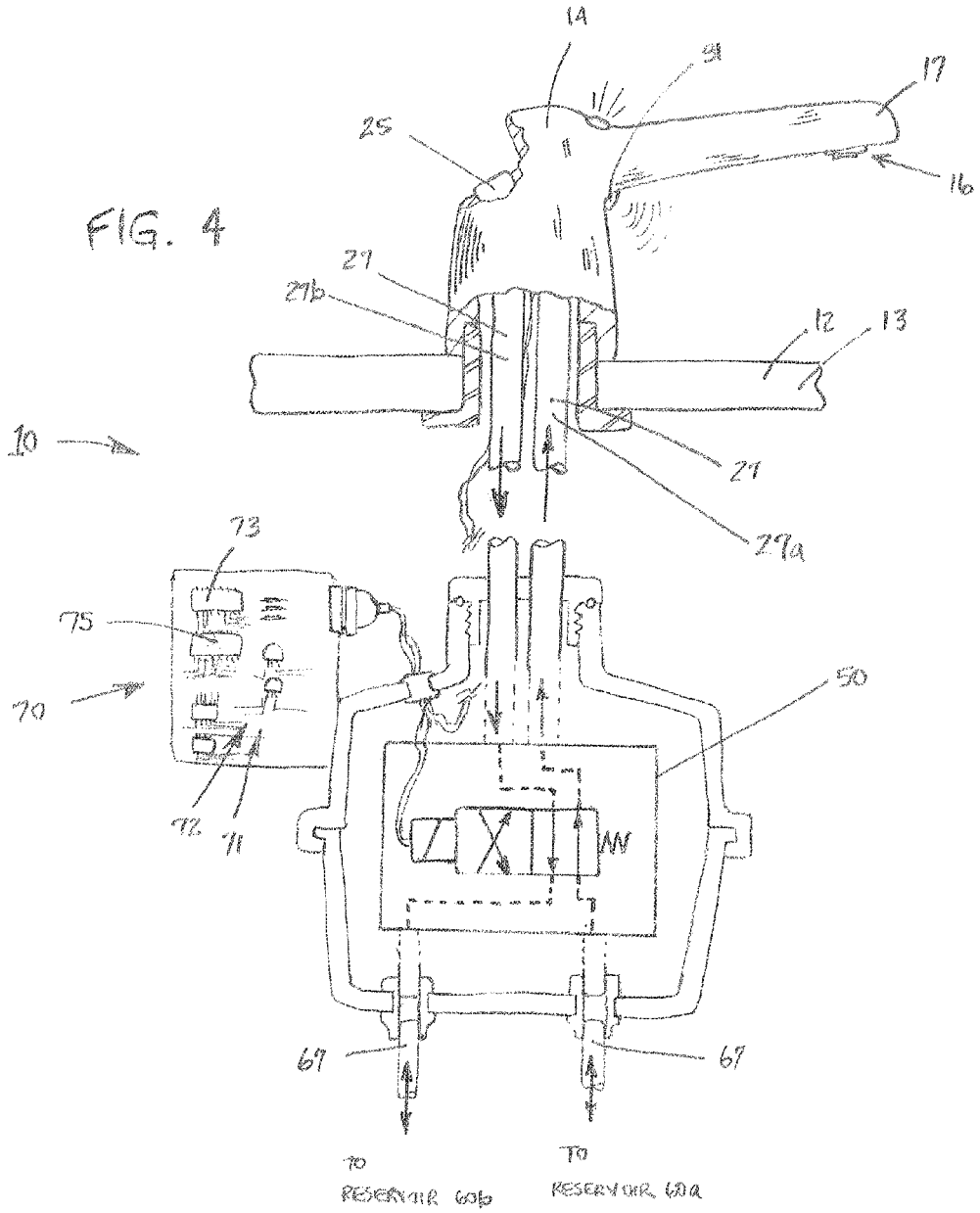
FIG. 4 is a partial cross sectional view of the fixture depicted in FIG. 2, along with control system circuitry and a schematic representation of a control valve of the fluid dispensing system, according to the embodiments of the subject invention.
Figure 5:
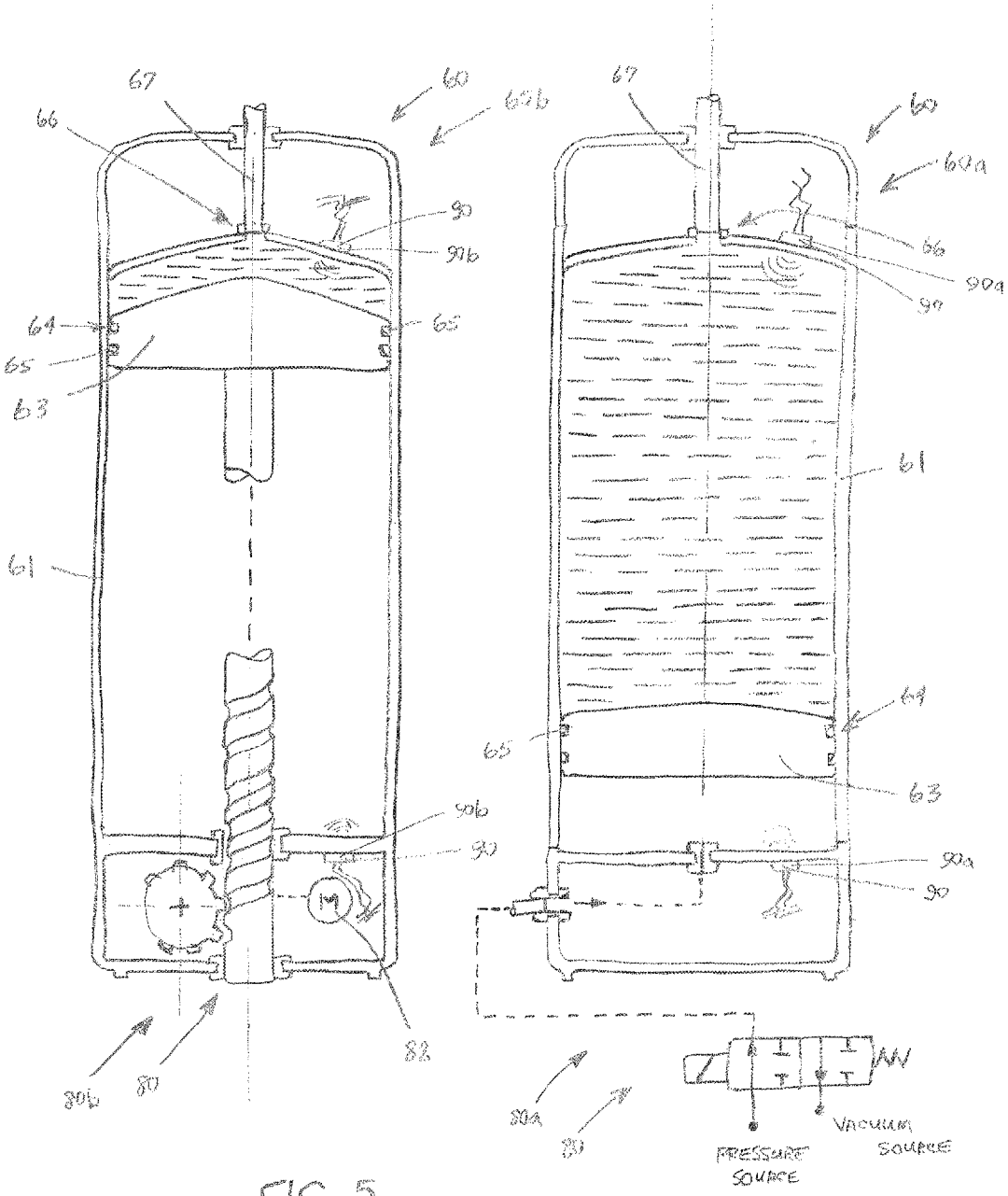
FIG. 5 is cross sectional view depicting multiple reservoirs of the fluid dispensing system, according to the embodiments of the subject invention.

With reference now to FIGS. 4 and 5, conduits 27 are connected to a valve, shown schematically at 50. The valve 50 functions to direct fluid to and from multiple fluid storage reservoirs 60, shown in FIG. 5. While the valve 50 is schematically depicted as a solenoid activated directional valve, it is to be construed that any type of valve mechanism may be used that switches fluid flow to the nozzle 16 from between the multiple reservoirs 60. In the current embodiment, the dispensing system 10 employs two reservoirs 60*a*, 60*b*. However, persons of skill in the art will recognize the application to three or more fluid storage reservoirs. It is noted that multiple reservoirs function to provide a constant supply of fluid product. Stated differently, the inclusion of multiple reservoirs means that one reservoir supplies fluid product while the other reservoir remains available for serviced, i.e. to be refilled with product.

From the aforementioned description and the accompanying figures, it can be seen that, in one state, valve 50 establishes a fluid pathway from the output of reservoir 60*a* to the nozzle 16. At the same time, valve 50 also establishes a fluid pathway between the connection port 25 and the second reservoir 60*b*. When reservoir 60*a* has been emptied of fluid product, the control system 70 will shift valve 50 to the second state, i.e. second position, whereby fluid reservoir 60*b* will be fluidly connected to the nozzle 16 and reservoir 60*a* will be in fluid communication with connection port 25.

With continue reference to FIG. 5, each of the fluid reservoirs 60 may comprise a generally elongate and cylindrical canister 61, although any geometric configuration may be selected with good judgment. Canister 61 defines a fluid tight, internal region having a volume V. In the current embodiment, each of the respective canisters 61 have the same volume V, but canisters having different volumes may be employed as well. By way of example, volume V may range from 100 milliliters up to several liters of fluid product. However, canisters 61 having a broader range of volumes may also be used.

Each canister 61 may include a piston head 63. The piston head 63 is constructed having an outer diameter, or other geometric configuration as may be the case, that closely matches the inner diameter of the canister 61. Grooves 64 may be formed on the perimeter of the piston head 63 for receiving sealing material 65, like for example an O-ring. However, it is noted that certain fluid products may inherently possess a viscosity that does not require the use of O-rings or any sealing material to be used between the piston head 63 and canister wall. In any instance, it will be appreciated that the whole dispensing system 10 is sealed from exposure to ambient air.

The canisters 61 include an outlet 66. The outlet 66 may reside at one end of the canister 61; preferably the top. Tubes 67 may extend from the outlet 66 to respective ports of the valve 50. Of course, tubes 67 are connected to their respective inlet and outlet in a fluid tight manner so as to prevent exposure to the atmosphere. Any manner of connecting the tubes 67 may be chosen including but not limited sealed connection fittings.

Still referencing FIG. 5, to expel fluid product from the reservoirs 60, i.e. canisters 61, each respective piston head 63 is connected to an actuator 80. While FIG. 5 depicts two different actuators 80, i.e. one for each canister, it does so only for illustrative purposes. Ideally, dispensing system 10 will use the same type of actuator 80 in both (or all) reservoirs 60. Examples of actuators include, but are not limited to: pneumatic pressure and vacuum sources, mechanical ballscrews, electric motors or coil springs. Still, other types of actuators may be used to displace the piston head 63.

The actuator 80 is generally capable of driving the piston in first and second directions. That is to say that the actuator 80 is functional both to push the piston head 63 in the direction of the outlet 66, and to draw the piston head 63 away from the outlet 66. Skilled artisans will immediately understand that driving the piston head 63 in the direction of the outlet 66 will pressurize the product in the canister 61. It follows that incremental advancement of the piston head 63 results in metered dispensing of the fluid product. When actuated in the opposite direction, the piston head 63 will conversely create a vacuum. In one embodiment, engaging the actuator 80 to move the piston head 63 away from the outlet 66 is used to automatically refill the canister 61 with product, as explained below.

With reference again to FIG. 4, dispensing system 10 includes a control system 70 comprising one or more electronic circuits 71 for controlling the sequence of operation of the dispensing system 10. The electronic circuitry 71 may reside on a printed circuit board and received in a suitable enclosure, not shown. An electrical power supply, also not shown, may be provided to power the electronic circuits 71. In one embodiment, electrical power for the control system 70 may comprise mains power supplied from the facility in which the dispensing system 10 is installed. Alternatively, onboard power may be provided in the form of one or more batteries, also not shown.

The electronic circuitry 71 of the control system 70 may comprise digital electronic circuitry 72 designed to receive and process data relating to operation of the dispensing system 10. In particular, the digital electronic circuitry 72 functions to receive input signals from the electronic validation key and onboard sensors 90. Such circuitry may utilize analog-to-digital converters. In one embodiment, the digital electronic circuitry 72 may comprise one or more logic processors 73, which may be programmable. Accordingly, circuitry 72 may further include electronic data storage 75 or memory 75.

The digital electronic circuitry 72 also functions to output signals used to control operation of the dispensing system 10, like for example operation of the valve 50 and activation of the actuators 80, which may include one or more electric motors 82. The output signals may therefore comprise low voltage DC signals and/or AC signals. Whatever the configuration, persons of skill in the art will understand the use and implementation of a wide array of circuitry as may be necessary for controlling operation of the dispensing system 10.

With reference again to FIG. 5, sensors 90 may be incorporated into the reservoirs 60 for determining the amount of fluid product remaining in each canister 61. The types of sensors used may include: limit switches, pressure sensors, encoders, or non-contact proximity sensors, like for example Hall-effect sensors. However, persons of skill in the art will understand that other types of sensors may be used. In determining how much fluid is remaining in the reservoirs 60, the sensors 90 may be configured to directly sense the presence or absence of fluid. Alternatively, the sensors 90 may be configured to detect the location of the piston head 63 and subsequently correlate position of the piston head to the amount of product remaining in the canisters 61. In still another embodiment, sensors may detect how much product remains by detecting activation or position of the actuators 80. These and other methods are to be construed as falling within the scope of coverage of the embodiments described herein.

In one particular embodiment, sensors 91 may also be incorporated into the fixture 14. These sensors 91 are used to detect motion for hands-free activation of the dispensing system 10. The sensors 91 may comprise one or more IR emitters and detectors. The emitter-detector pairs may be oriented in any manner to ensure consistent activation in a particular region under the nozzle 16.

With reference again to FIGS. 1 through 5, one embodiment of operating the dispensing system 10 will now be described. Upon initial activation or reset of the control system 70, a default reservoir (for discussion purposes fluid reservoir 60*a*) may be predetermined, i.e. programmed, from which to begin dispensing fluid product. When the dispensing system 10 is activated by the user, via sensors 91, the control system 70 will check to see if there is product in the canister 61*a* by reading the output of sensor 90*a*. If fluid product is present, the control system 70 will output a signal to actuator 80*a* to drive piston head 63*a* forward for dispensing a metered amount of fluid product. As long as sensor 90*a* continues to indicate that fluid product is present, control system 70 will engage actuator 80*a* with every activation of the sensors 91. When the signal from sensor 90*a* indicates that the canister 61*a* is empty, the control system 70 will then begin drawing fluid product from reservoir 60*b* by shifting the valve 50 to its alternate state. Additionally, control system 70 will output a signal to turn on an indicator for signaling to service personnel that maintenance is required. In one embodiment, the indicator may be an indicator light 94 positioned on the fixture 14. Alternatively, the indicator may be audible in nature. Moreover, the indicator may be a wireless signal sent to a network monitored by service personnel. Still, any manner of signaling that the dispensing system 10 requires service may be chosen.

During the refill cycle, service personnel may attach the connection fitting 37 from a refill container 31 to the connection port 25 of the fixture 14. The control system 70 will check the signal received by the interrogator 42 to ensure that the correct refill unit has been installed. Upon verification, the control system 10 will output a signal to the actuator of the canister that is signaling "empty." The actuator will then draw the piston head away from the outlet 66 creating a vacuum that refills the canister.

Figure 6:
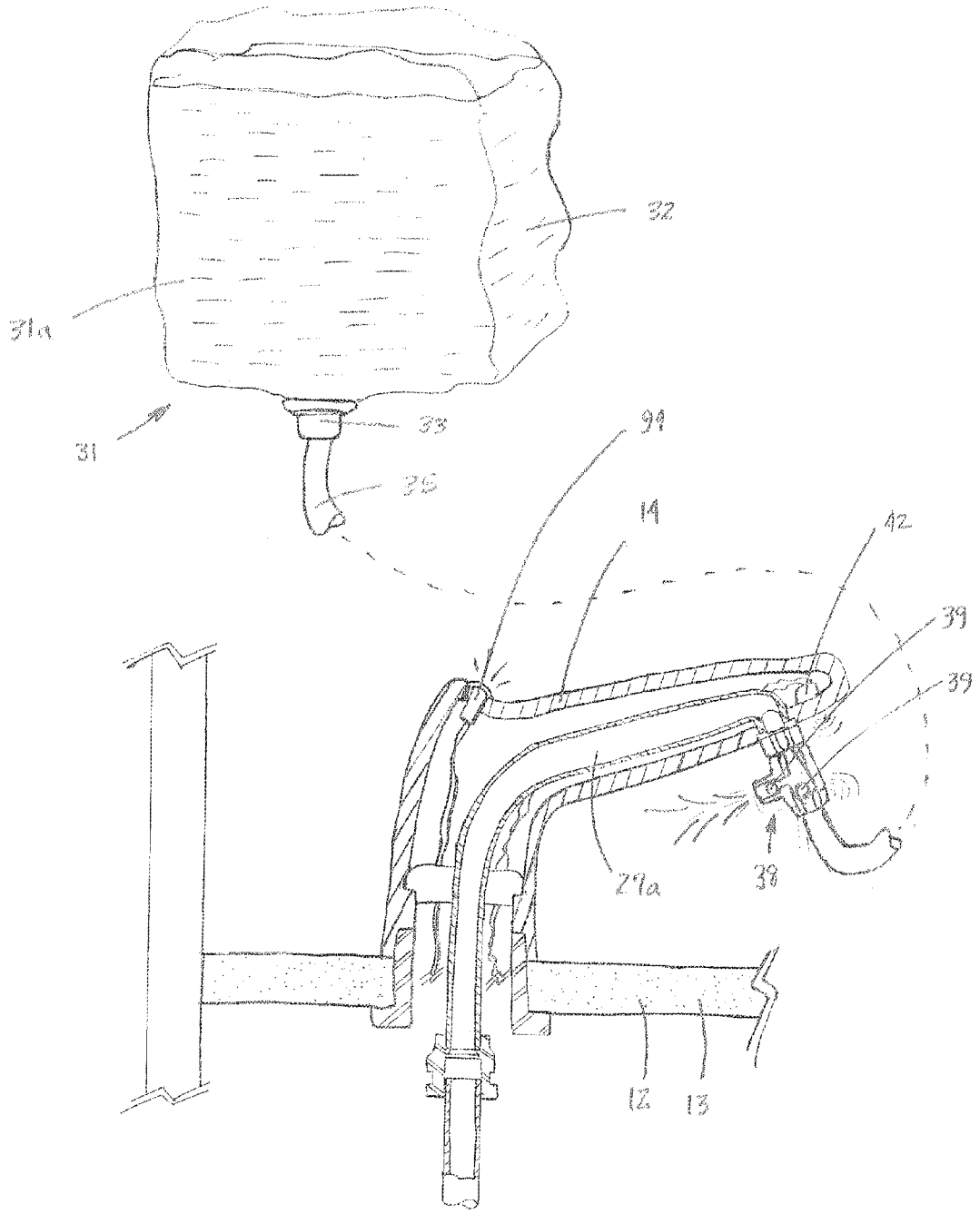
FIG. 6 is a cross sectional view of another embodiment of the fixture of the dispensing system and a refill unit, according to the embodiments of the subject invention.

With reference now to FIG. 6, an alternate embodiment of the dispensing system 10 is illustrated. In this embodiment, the dispensing system 10 uses the nozzle 16 both to dispense product and to refill the reservoirs 60. Accordingly, the fixture 14 contains a single conduit 27*a*. When it is required to refill the reservoirs, the connection fitting 37 of the refill container 31 is connected to the nozzle 16. The interrogator 42 similarly verifies that a proper refill container 31 is being used. In this instance, it may be necessary to cycle valve 50 so that the fluid pathway is connected to the appropriate reservoir 60, namely the reservoir empty of product. Subsequently, the control system 70 engages the appropriate actuator 80 to create a vacuum thereby drawing fluid product into the reservoir. After the refill cycle has been completed, the control system 70 will switch valve 50 back to its previous state so that fluid product may continue to be dispensed from the other reservoir.

In the current embodiment, the connection fitting 37 may be configured with a bleed port 38. To ensure that no fluid product that has been exposed to ambient air is drawn back into the reservoirs 60, a purge cycle may be programmed into the control system 70. During the purge cycle, the control system 70 may drive the appropriate actuator 80 forward to bleed out fluid product residing at the nozzle 16 that may have been exposed to the air. It follows that when the fitting 37 is connected to the nozzle 16, fluid product will flow through the bleed port 38. Subsequently, the control system 70 will automatically engage the actuator in the opposite direction to draw fluid from the refill container 31 into the empty reservoir. Skilled artisans will comprehend that the connection fitting 37 may be designed to include one or more valves, which may be a check valves 39, to prevent leakage of fluid product through the bleed port 38 during the refill process.

Figure 7:
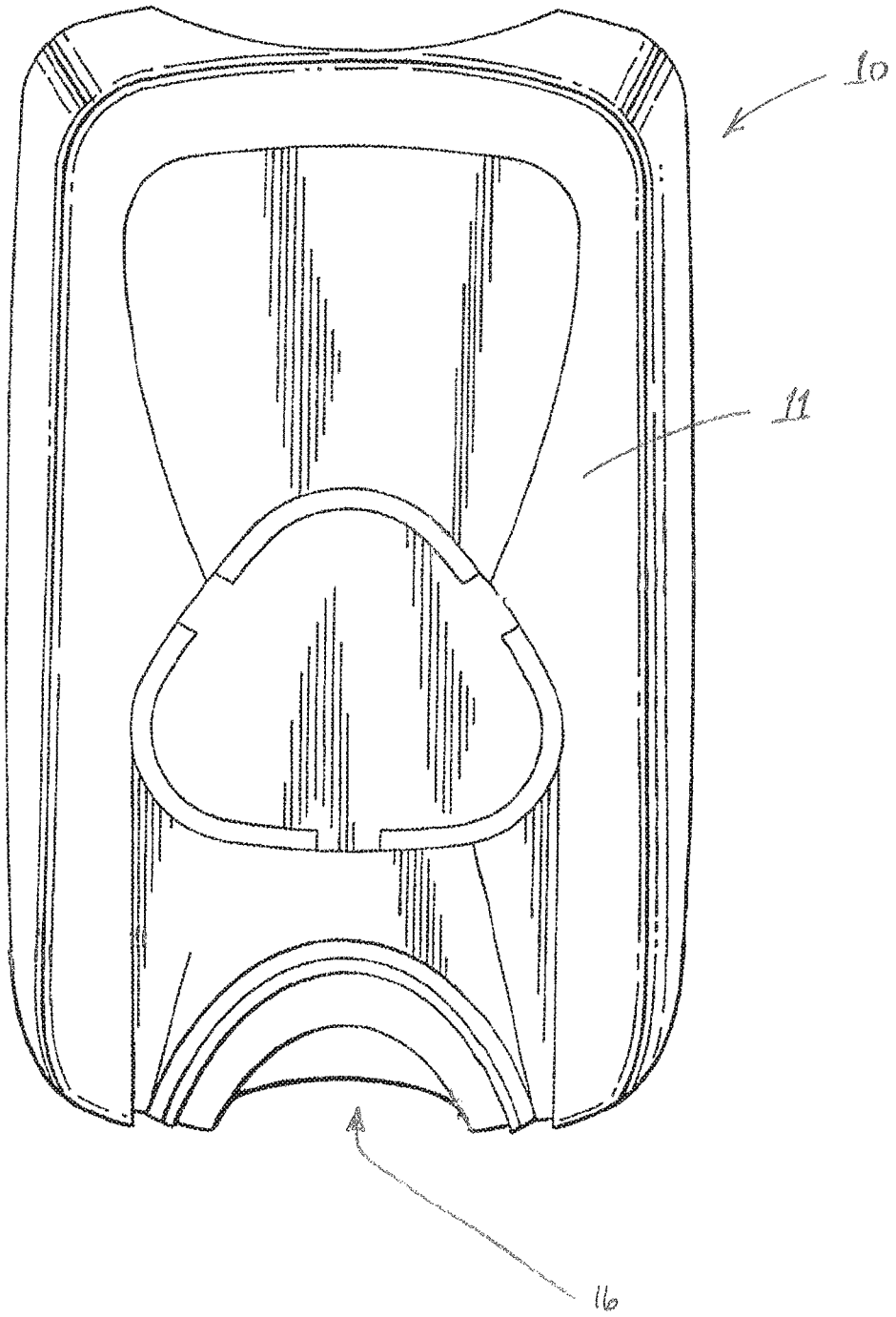
FIG. 7 is a front elevation view of a wall mounted dispenser, according to yet another embodiment of the subject invention.
Figure 8:
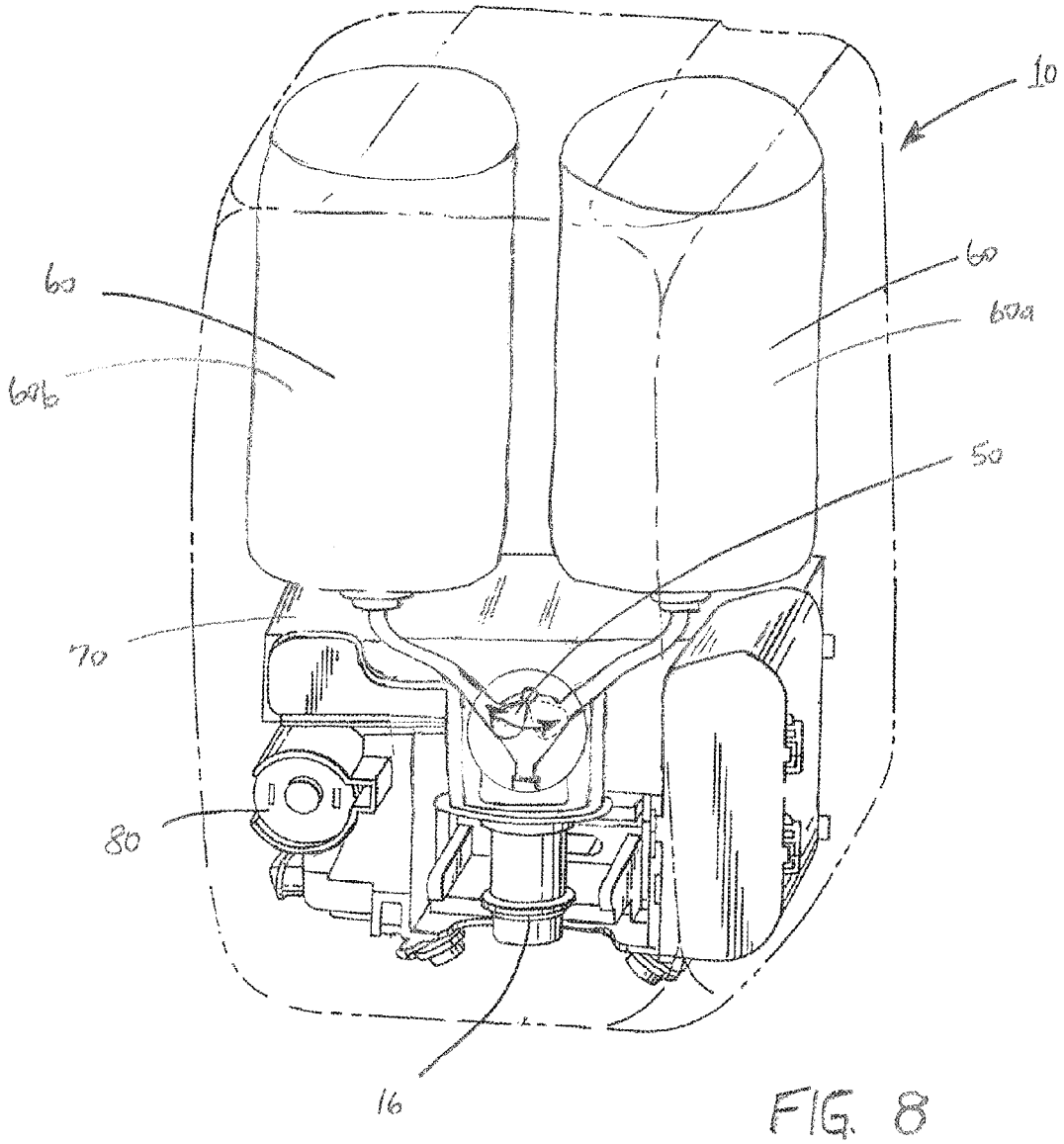
FIG. 8 is a perspective view of a wall mounted dispenser showing multiple reservoirs of the fluid dispensing system depicted in FIG. 7.

Referencing FIGS. 7 and 8, the aforementioned embodiments have been directed to a counter mounted dispensing system. In these embodiments, the fixture and reservoir are separately mounted. However, alternate embodiments are contemplated where the components of the dispensing system 10 are contained in a single enclosure 11. In one particular embodiment, reservoirs 60*a*, 60*b*, valve 50, control system 70 and nozzle 16 are all contained in a single enclosure 11. As illustrated by the figures, the enclosure 11 may be a wall mounted enclosure. The multiple reservoirs received within the enclosure may function in the same manner as that described above. Refilling of the dispensing system 10 may be accomplished through the nozzle 16, or alternatively by way of a separately provided connection port, not shown in FIGS. 7 and 8.

Having illustrated and described the principles of the multi-reservoir dispensing system in one or more embodiments, it should be readily apparent to those skilled in the art that the invention can be modified in arrangement and detail without departing from such principles.

What is claimed is:

1. A fluid dispensing system, comprising:
a first fluid reservoir for storing fluid;
a second fluid reservoir for storing fluid;
a fixture for dispensing fluid from the first fluid reservoir and the second fluid reservoir and for replenishing the first fluid reservoir and the second fluid reservoir with fluid, the fixture comprising a refill connection port to which a refill container comprising fluid for replenishing at least one of the first fluid reservoir or the second fluid reservoir is selectively coupled; and
a valve, wherein:
the valve, while in a first state, establishes a fluid pathway between a nozzle of the fixture and the first fluid reservoir; and
the valve, while in a second state, establishes a fluid pathway between the nozzle and the second fluid reservoir.

2. The fluid dispensing system of claim 1, wherein:
no fluid pathway exists between the nozzle and the first fluid reservoir while the valve is in the second state; and
no fluid pathway exists between the nozzle and the second fluid reservoir while the valve is in the first state.

3. The fluid dispensing system of claim 1, at least one of the first fluid reservoir or the second fluid reservoir comprising:
a canister for storing fluid;
a piston head; and
an actuator configured to drive the piston head in a first direction and a second direction.

4. The fluid dispensing system of claim 3, wherein:
the piston head pressurizes fluid stored within the canister when driven in the first direction to dispense fluid from the canister; and
the piston head creates a vacuum within the canister when driven in the second direction to draw fluid into the canister.

5. The fluid dispensing system of claim 1, wherein:
the valve, while in the first state, establishes a fluid pathway between the refill connection port and the second fluid reservoir; and
the valve, while in the second state, establishes a fluid pathway between the refill connection port and the first fluid reservoir.

6. The fluid dispensing system of claim 1, comprising an interrogator for verifying the refill container prior to replenishing the at least one of the first fluid reservoir or the second fluid reservoir.

7. The fluid dispensing system of claim 1, the fixture comprising an indicator for notifying service personnel that maintenance is requested.

8. The fluid dispensing system of claim 3, comprising:
an interrogator for verifying the refill container prior to replenishing the at least one of the first fluid reservoir or the second fluid reservoir; and
a control system configured to output a signal to the actuator responsive to the interrogator verifying the refill container, the signal triggering the actuator to drive the piston head to create a vacuum that replenishes the at least one of the first fluid reservoir or the second fluid reservoir using the refill container.

9. A fluid dispensing system, comprising:
a first fluid reservoir for storing fluid;
a second fluid reservoir for storing fluid;
a fixture for dispensing fluid from the first fluid reservoir and the second fluid reservoir and for replenishing the first fluid reservoir and the second fluid reservoir with fluid; and
a valve, wherein:
the valve, while in a first state, establishes a fluid pathway between a nozzle of the fixture and the first fluid reservoir;
the valve, while in a second state, establishes a fluid pathway between the nozzle and the second fluid reservoir; and
the nozzle of the fixture is configured to receive a connection fitting of a refill container comprising fluid for replenishing at least one of the first fluid reservoir or the second fluid reservoir.

10. The fluid dispensing system of claim 9, wherein:
no fluid pathway exists between the nozzle and the first fluid reservoir while the valve is in the second state; and
no fluid pathway exists between the nozzle and the second fluid reservoir while the valve is in the first state.

11. The fluid dispensing system of claim 9, at least one of the first fluid reservoir or the second fluid reservoir comprising:
a canister for storing fluid;
a piston head; and
an actuator configured to drive the piston head in a first direction and a second direction.

12. The fluid dispensing system of claim 11, comprising:
an interrogator for verifying the refill container prior to replenishing the at least one of the first fluid reservoir or the second fluid reservoir; and
a control system configured to output a signal to the actuator responsive to the interrogator verifying the refill container, the signal triggering the actuator to drive the piston head to create a vacuum that replenishes the at least one of the first fluid reservoir or the second fluid reservoir using the refill container.

13. The fluid dispensing system of claim 11, wherein:

the piston head pressurizes fluid stored within the canister when driven in the first direction to dispense fluid from the canister; and the piston head creates a vacuum within the canister when driven in the second direction to draw fluid into the canister.

14. The fluid dispensing system of claim 9, comprising an interrogator for verifying the refill container prior to replenishing the at least one of the first fluid reservoir or the second fluid reservoir.

15. The fluid dispensing system of claim 9, the fixture comprising an indicator for notifying service personnel that maintenance is requested.

* * * * *